US005674085A

United States Patent [19]

Davis et al.

[11] Patent Number: 5,674,085

[45] Date of Patent: Oct. 7, 1997

[54] ELECTRICAL CONNECTOR WITH SWITCH

[75] Inventors: Wayne Samuel Davis, Harrisburg; Robert Neil Whiteman, Jr., Middletown, both of Pa.

[73] Assignee: The Whitaker Corporation, Wilmington, Del.

[21] Appl. No.: 681,580

[22] Filed: Jul. 29, 1996

Related U.S. Application Data

[63] Continuation-in-part of Ser. No. 653,144, May 24, 1996.

[51] Int. Cl.[6] ..... H01R 13/703

[52] U.S. Cl. ..... 439/188; 200/51.1; 439/607

[58] Field of Search ..... 439/188, 607; 200/51.1

[56] References Cited

U.S. PATENT DOCUMENTS 4,070,557 1/1978 Ostapovitch ..... 439/188

4,725,241 2/1988 Bertini et al. ..... 439/188

5,195,902 3/1993 Bengal ..... 439/188

*Primary Examiner*—Neil Abrams

*Attorney, Agent, or Firm*—Anton P. Ness

[57] ABSTRACT

An electrical connector (10) having contacts (16,18) extending from a mating face to a rear face, and including a switch contact (70) mounted along the rear face with a spring arm (76) adjacent the mating face. The spring arm (76) includes a contact-engaging section (80) proximate a deflectable leading end (78) that is engaged with a selected contact (18) when the connector is unmated. The leading end (78) is abutted by the mating connector upon full mating, disengaging the switch contact (70) from the selected contact (18) and indicating full mating.

7 Claims, 4 Drawing Sheets

ELECTRICAL CONNECTOR WITH SWITCH

RELATED APPLICATION INFORMATION

This is a continuation-in-part of U.S. patent application Ser. No. 08/653,144 filed May 24, 1996 and assigned to the assignee hereof.

FIELD OF THE INVENTION

The present invention is directed to electrical connectors, and more particularly to connectors containing an indication of full mating.

BACKGROUND OF THE INVENTION

It is desired in certain mating electrical connector assemblies to provide an indication that the pair of connectors is fully mated. For example, in U.S. Pat. No. 4,070,557, a shunt is contained within the receptacle connector housing having an array of signal contacts in a plug-receiving cavity, and the shunt includes a deflectable section that is spring biased in engagement with a pair of the contacts when the connector is unmated, and is deflected out of engagement upon receipt of a mating plug connector into the receptacle's cavity during mating, thereby breaking the interconnection of the pair of contacts which become mated with contacts of the plug connector. In U.S. Pat. No. 4,725,241 a jack connector housing includes in addition to its signal contacts disposed in a plug-receiving cavity, a set of contacts in a compartment wherein one includes a spring arm in engagement with another of the set until cammed away by a cam member of the jack upon receipt of a plug connector into the cavity during mating; the contacts of the set include sections extending out of the housing for interconnection such as with a circuit board.

Certain electrical connectors are known that possess a mating interface having a selected number of electrical contacts in plug and receptacle connectors, and are sold by AMP Incorporated, Harrisburg, Pa., USA as "Universal Serial Bus" connectors, Series A, Part Nos. 787616 and 95-8083-20, that are particularly useful in computer terminals at input/output ports.

It is desired to provide a full mating indicator without necessitating any modification of the positions of the contacts along the mating interface.

It is also desired to provide a mating indicator contact member having a repeatedly cleaned contact surface.

SUMMARY OF THE INVENTION

The electrical connector of the present invention includes a switch contact member additional to several other contacts without necessitating modification of the contact positions along the mating interface of a known connector, nor modification to the contacts thereof. The switch contact is mounted rearwardly of the mating interface and includes a contact section on a deflectable spring arm extending through a recess or passageway of the insulative housing to engage a selected other contact along the mating interface when the connector is unmated. The leading end of the spring arm is exposed to be engaged by a portion of the mating connector when the connectors have been moved into a fully mated condition. Upon full mating the engaged spring am is deflected out of engagement with the selected other contact, breaking an electrical circuit therewith and thus indicating full mating. Upon unmating, the spring arm resiles into engagement with the selected other contact reestablishing the circuit to indicate an unmated condition, and in resiling wipes along the selected other contact to remove oxides beginning to form on the contact-engaging surfaces thereof.

It is an objective of the present invention to provide an electrical indication of a fully mated condition and hence also an unmated condition.

It is a further objective to provide such an indication in a connector having a standard mating interface, namely, a fixed number of contacts establishing a fixed number of circuits with the mating connector, without changing the position of any thereof and thus being matable with commercially available mating connectors.

It is additionally an objective to provide a contact for mating indication that becomes moved during mating and unmating for the contact-engaging surface thereof to wipe along a selected contact to maintain a clean contact-engaging surface.

An embodiment of the present invention will now be described by way of example with reference to the accompanying drawings.

DETAILED DESCRIPTION

Figure 1:
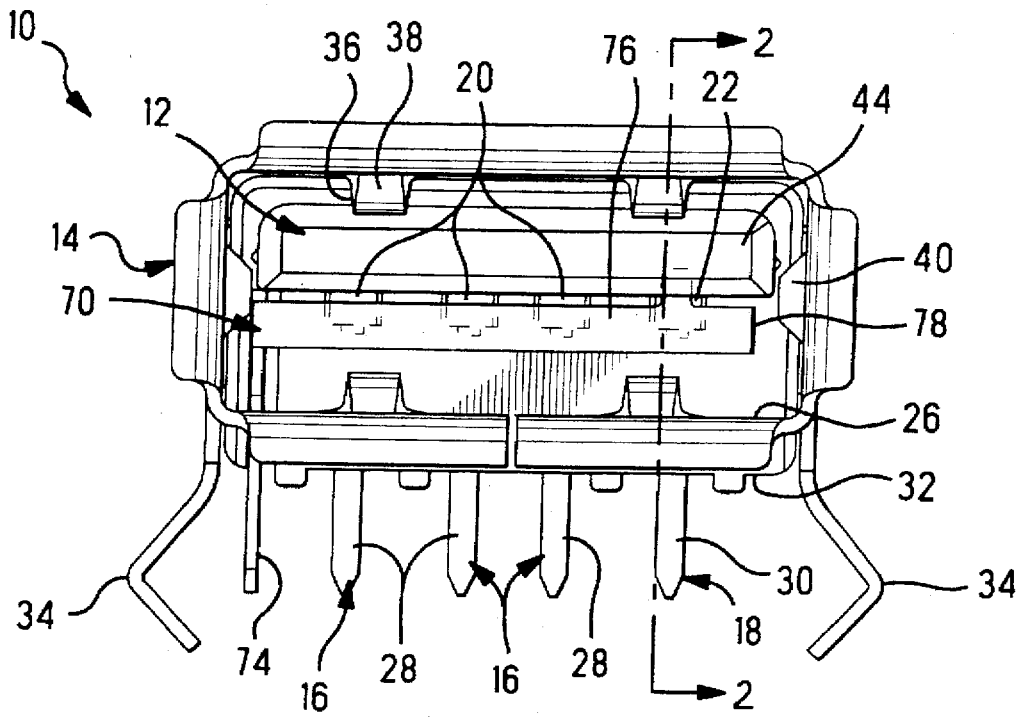
FIG. 1 is an elevation view of an electrical connector containing the present invention.
Figure 2:
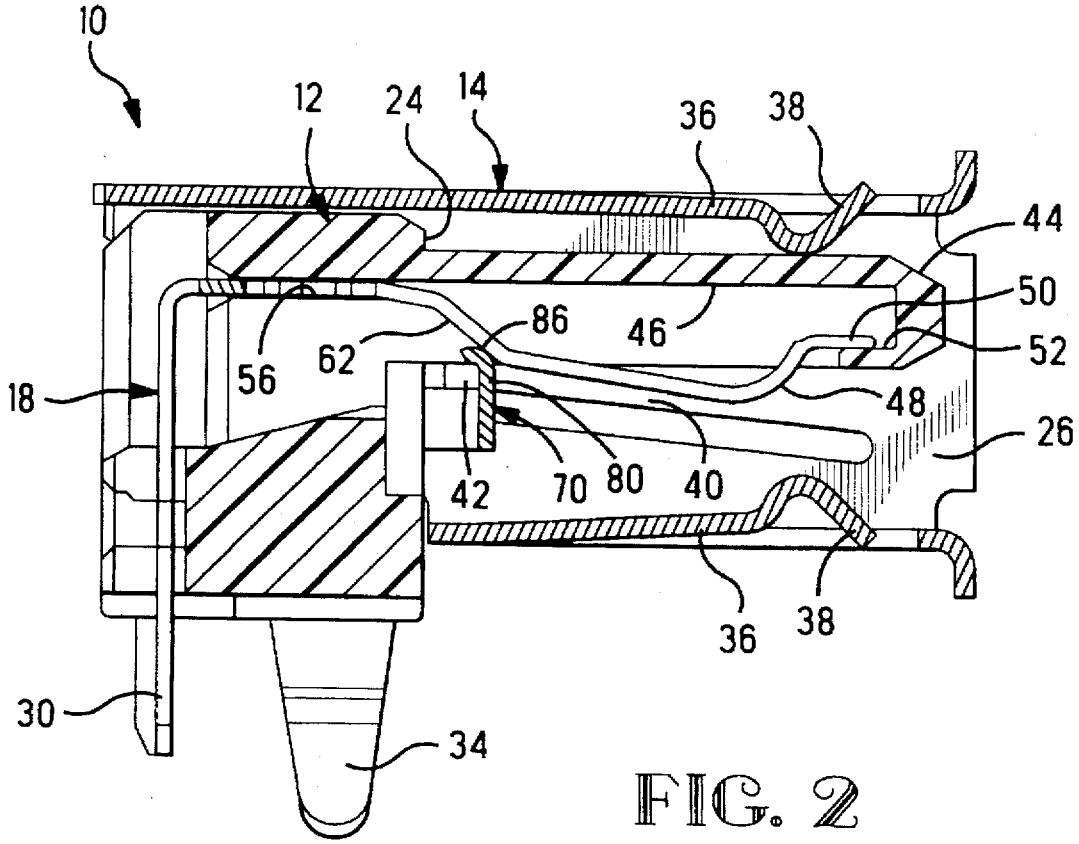
FIG. 2 is a longitudinal section view of the connector of FIG. 1 taken along lines 2—2 thereof, illustrating the switch contact and a selected signal contact in engaged relationship.

Connector 10 in FIGS. 1 and 2 is shown to be of the type having a housing 12 disposed within a shell 14 and containing a plurality of signal contacts 16,18 having contact sections 20,22 arrayed across a mating face at a connector portion forwardly of housing wall 24 and within a plug-receiving cavity 26 of the connector. Contacts 16,18 also include board-connecting contact posts 28,30 depending from board-mounting face 32 of the connector, for receipt into through-holes of a circuit board (not shown) for connection to circuits of the board.

Shell 14 is shown to include board-mounting legs 34 also depending from board-mounting face 32 to secure the connector to the board. Shell 14 extends forwardly to a leading end and defines plug-receiving cavity 26 forwardly of vertical wall 24 enclosing the forward connector portion, and provides retention arms 36 having embossed leading ends 38 that seat within corresponding recesses into the outer surfaces of a mating plug connector (not shown) upon mating to retain the connectors in mated relationship. Shell 14 also includes grounding arms 40 that extend rearwardly to free ends 42 that engage outer surfaces of the shell of the plug connector upon mating.

Housing 12 provides a contact support wall 44 that extends forwardly in plug-receiving cavity 26 and contains channels 46 within and along which contact sections 20,22 of contacts 16,18 extend, with intermediate convex contact portions 48 protruding above the surface of support wall 44 to be engaged by complementary contacts of the plug connector. Free ends 50 of contacts 16,18 are trapped beneath undercuts 52 at leading ends of channels 46 for precise positioning and protection, and are spring biased against the undercut upon assembly, all as is known. Body sections 54 provide barbs to engage side walls of passageways 56 for retaining the contacts in the housing.

Figure 5:
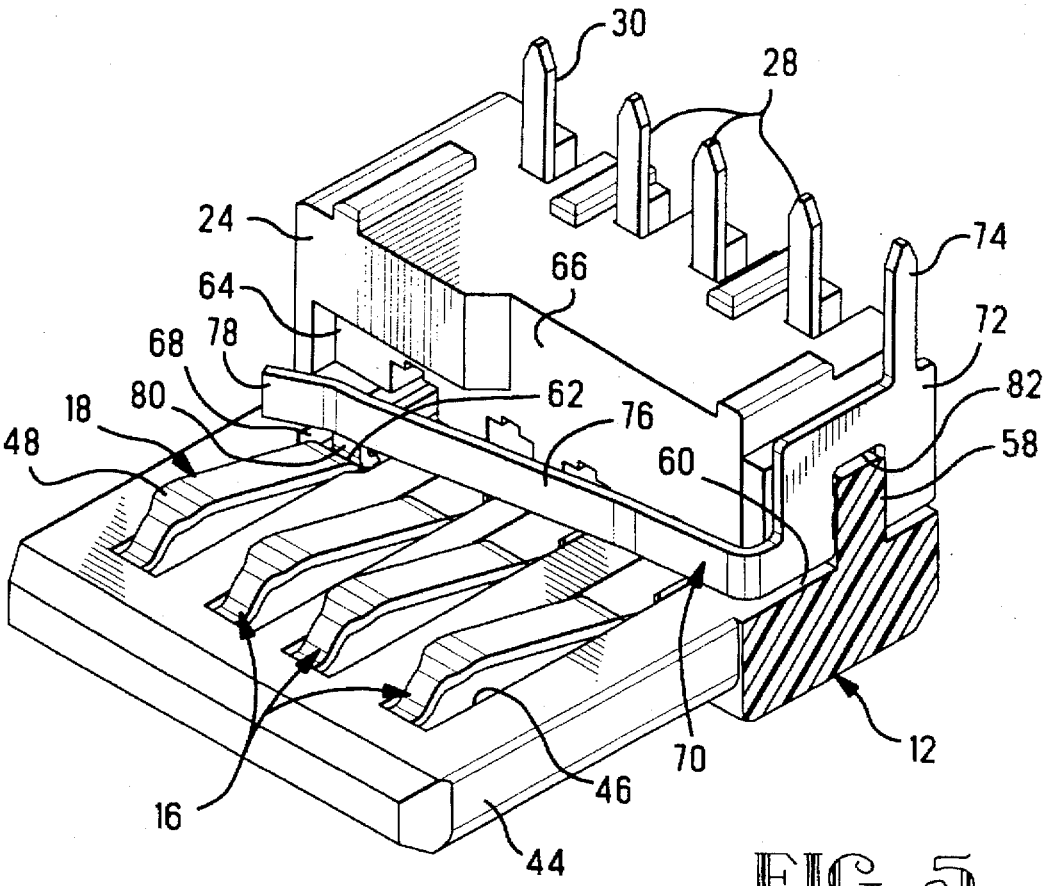
FIG. 5 is an isometric view of the assembly of FIG. 4 with part of the housing broken away.
Figure 6:
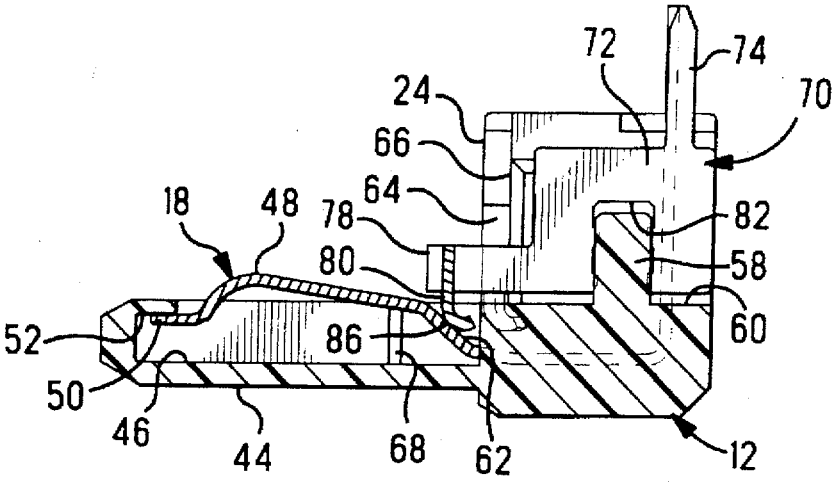
FIG. 6 is a longitudinal section view of the assembly of FIG. 4.

In accordance with the present invention, a switch contact 70 (best shown in FIG. 3) is inserted into the housing and engages a selected signal contact 18 when the connector is in an unmated state, and becomes disengaged therefrom when in a mated state. Switch contact 70 includes a body section 72, board-connecting section 74, spring arm 76 extending to a free end 78 at or near which is a forwardmost portion comprising a connector-engaging surface, and a contact-engaging section 80 located proximate free end 78. Body section 72 includes a slot 82 having barbs 84 along opposed edges thereof to grip therebetween rib 58 in contact-receiving slot 60 of housing 12, best seen in FIGS. 5 and 6. Board-connecting section 74 is to be electrically connected to a circuit of the circuit board utilized to indicate whether or not a fully mated condition exists.

Contact-engaging section 80 is of limited length preferably extending laterally from a lower edge of spring arm 76 and is formed to extend arcuately rearwardly, defining a forwardly-facing bearing surface 86 for engagement with selected contact 18. The engagement surface of selected contact 18 is along transition section 62 somewhat steeply angled extending from body section 54 to intermediate section 48. For simplified manufacture, all contacts 16,18 are identical and thus all are shown to have transition sections 62.

Figure 4:
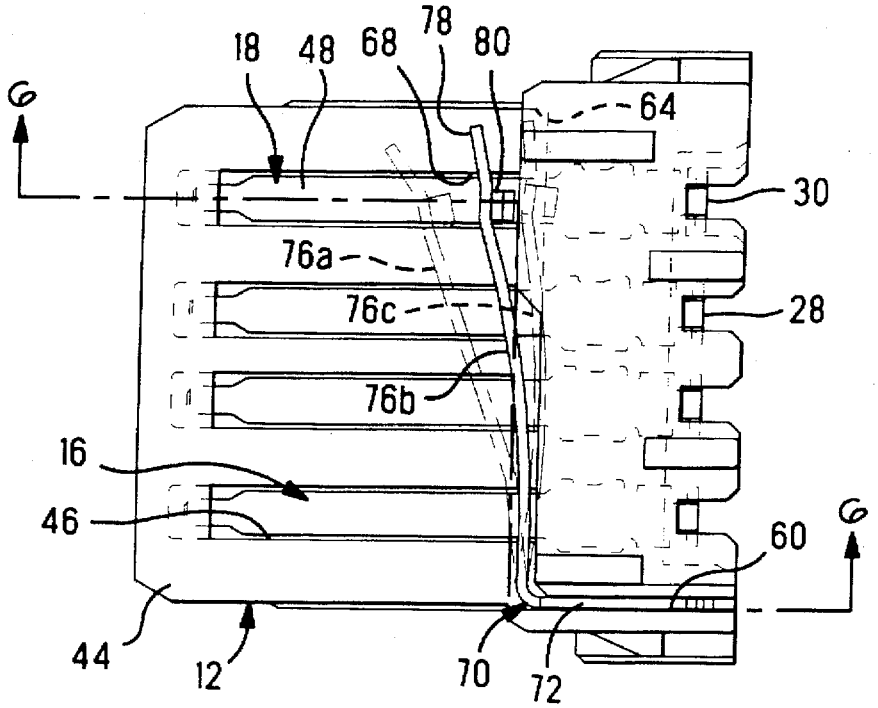
FIG. 4 is a plan view of the housing of FIG. 3 after assembly of the signal contacts and switch contact thereinto.

Prior to loading of switch contact 70 into housing 12, spring arm 76 has been formed to extend from body section 72 at less of an angle, represented in FIG. 4 as **76*a* in phantom, so that upon loading, contact section 80 will be spring loaded against transition section 62 of contact 18 as spring arm is moved to a sharper angle more transverse, represented as 76*b*. Leading end 78 of switch contact 70 with its forwardmost connector-engaging surface, is so positioned in the plug-receiving cavity 26 as to be abutted by the forward end of the mating plug connector (not shown) and urged rearwardly thereby toward vertical housing wall 24 during final stages of connector mating when the plug connector is being inserted, and the deflected position of the spring arm of the switch contact is represented as 76*c*** in phantom.

Figure 3:
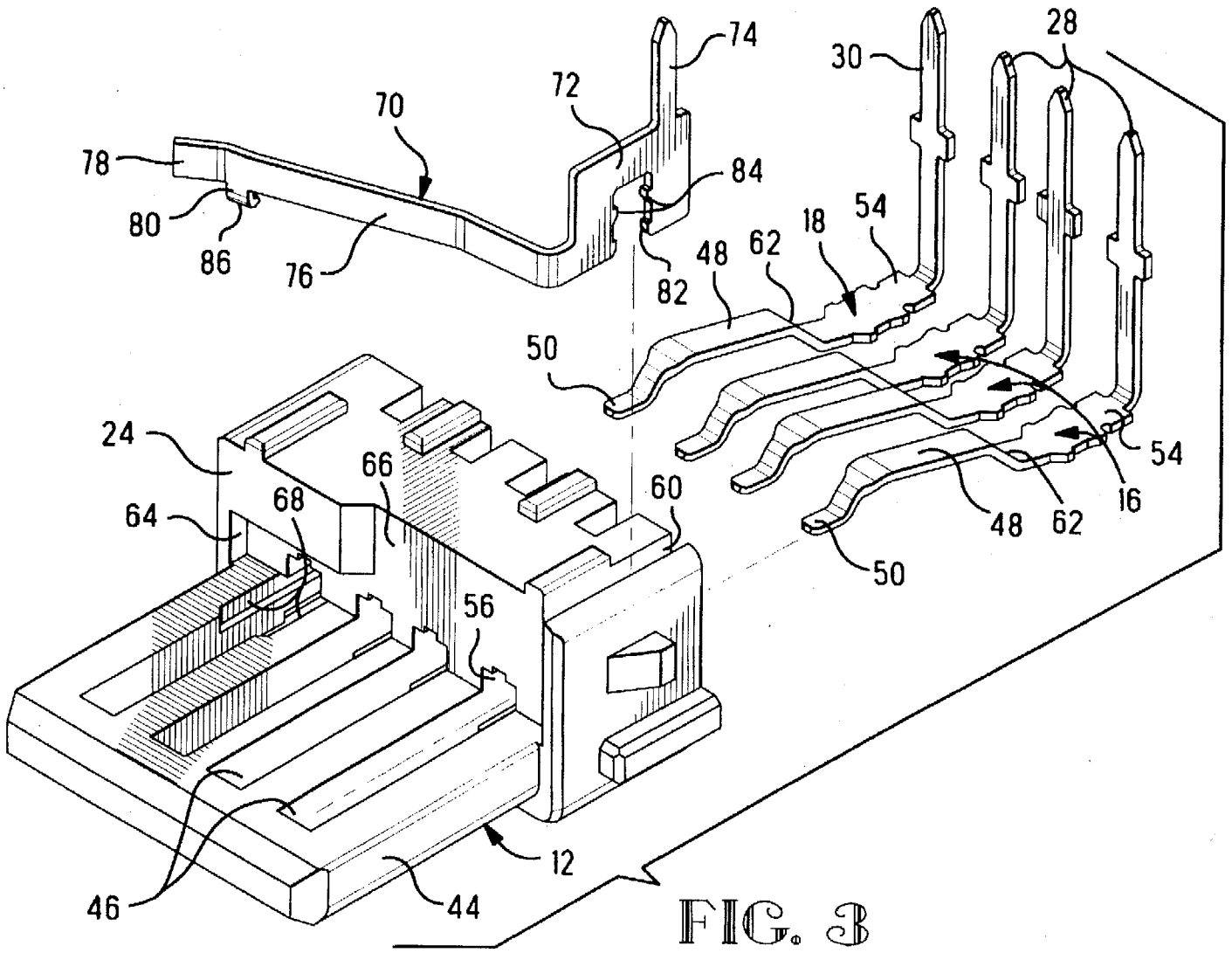
FIG. 3 is an isometric view of the housing of the connector of FIG. 1 with signal contacts and the switch contact of the present invention exploded therefrom positioned for insertion thereinto.

As shown in FIGS. 3 and 4, housing 12 includes clearance area 64 into vertical wall 24 providing clearance for spring arm 76 and tooling for loading the switch contact into the housing, where the tooling holds the spring arm in position **76*b*. Housing 12 also includes relief area 66 into vertical wall 24 for receipt of the spring arm thereinto when deflected. Contact-engaging section 80 extends laterally for a short distance from an edge of spring arm 76 to engage contact 18, with the remainder of spring arm 76 being spaced substantially from the other contacts 16 and also from selected contact 18 when deflected in position 76*c* for assured electrical isolation therefrom. Housing 12 further preferably includes relief areas 68 along side walls of channel 46 for selected contact 18 to assure freedom from any interfering engagement of housing 12 with contact-engaging section 80 when spring arm 76 is being moved into or out of its fully deflected position 76*c***.

Figure 7:
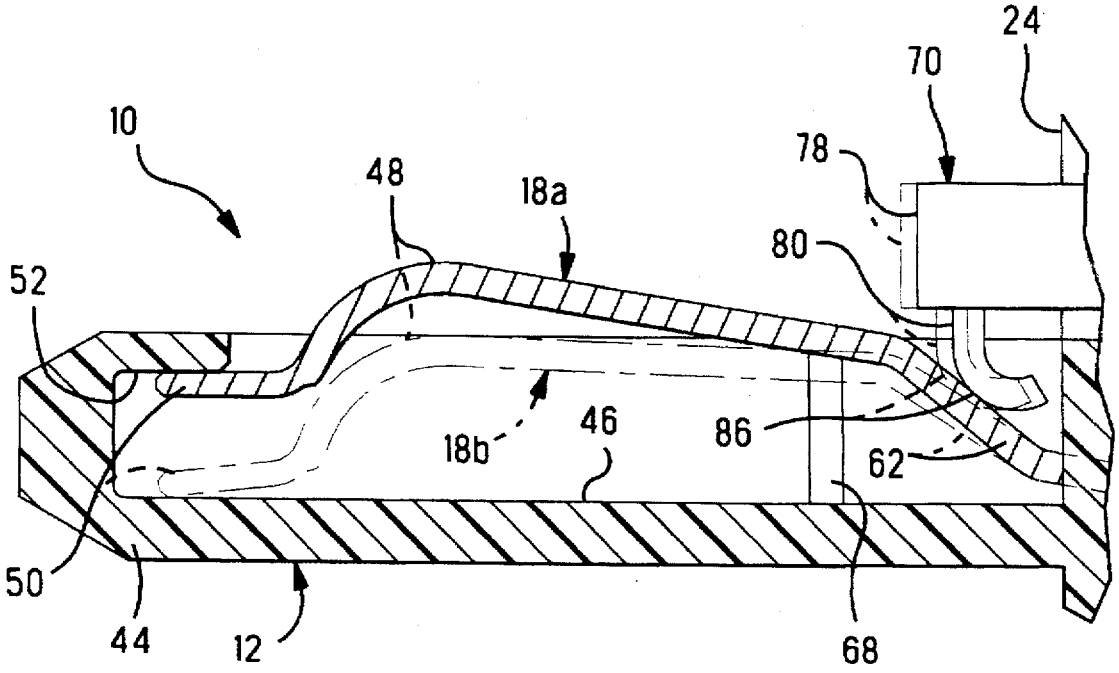
FIG. 7 is an enlarged section view of the connection of the switch contact with a selected contact in accordance with the invention.

Referring now especially to FIG. 7, during mating and unmating, bearing surface 86 wipes along portions of the surface of transition section 62, thus cleaning both surfaces of any corrosion layer. Preferably, both bearing surface 86 and the surface of transition section 62 are plated with gold to optimize the assured electrical engagement therebetween and minimize corrosion buildup. In FIG. 7, the unmated state is illustrated, with the position of selected contact identified as contact **18*a*; the fully deflected position thereof is shown in phantom and identified as contact 18*b*. The preferred relatively sharp or steep angle of transition section 62 provides a more positively defined forwardmost location for the contact-engaging section 80 of the switch contact 70 even as the intermediate section 48 of selected contact 18*b* has been initially engaged and deflected toward support wall 44 and relatively completely into channel 46 by a mating contact during plug mating while still defining a surface engaged by contact section 80. The steep transition section 62 provides control over the location of the contact-engaging section 80, preventing the spring arm from inadvertently moving forwardly along intermediate section 48 when the plug connector has deflected contact 18 but prior to abutting leading end 78**.

Similarly, when the plug connector is being withdrawn during unmating, the contact 18 remains deflected but switch contact leading end 78 is spring biased to move forwardly as the leading end of the plug connector retreats: steep transition section 62 permits only incremental forward movement of the contact-engaging section 80 until contact 18 resiles out of channel 44. Finally, the steep angle of transition 62, although it is not preferred to be vertical, still effectively creates a distinctly limited range of positions of the contact-engaging section 80 so that a distinct engaged/nonengaged relationship is established to indicate a fully mated as opposed to unmated or only partially mated relationship between the connectors.

The embodiment of the present invention described hereinabove requires minimal modification to a commercial connector, and no modification to the spacing of the contacts along the mating interface, nor any modification to the commercially available mating connector. The commercially available mating connector is sold by AMP Incorporated, Harrisburg, Pa., USA, under the identification "Universal Serial Bus" plug connector having Part No. 95-8083-20. The previous connector to which modification has been made, is similarly sold as "Universal Serial Bus" receptacle connector having Part No. 787616, by AMP Incorporated.

Variations and modifications may be made to the specific embodiment disclosed herein, that are within the spirit of the invention and the scope of the claims.

What is claimed is:

1. An electrical connector comprising:

an insulative housing and a selected number of contacts disposed therein extending from a mating face at a forward portion to a rear face, said contacts having respective first contact sections exposed along the mating face for electrical engagement with complementary contacts of a mating connector, and second contact sections exposed along said rear face and connectable to another electrical article; and a switch contact affixed to the housing remote from said mating face, said switch contact including a body section secured to said housing, a contact section extending from said body section and exposed for connection to said another electrical article, and a spring arm extending from said body section;

said switch contact spring arm extending across said forward portion to a leading end and includes a contact-engaging section spaced from said body section and spring biased against a portion of a selected one of said contacts when the connector is in an unmated condition, said spring arm being spaced from all others of said contacts and said housing adapted to permit rearward deflection of said spring arm, and said switch contact further including a connector-engaging portion at least proximate said leading end to be abutted by a portion of said mating connector during final stages of connector mating, such that said connector-engaging portion is urged rearwardly to deflect said spring arm thereby disengaging said contact-engaging section from said selected one of said contacts, whereby a circuit is established by said second contact section of said selected one of said contacts and said contact section of said switch contact when said switch contact is engaged with said selected one of said contacts, and said circuit is interrupted upon mating by said mating connector.

2. The electrical connector as set forth in claim 1 wherein said contact-engaging section extends laterally from a side edge of said spring arm proximate said leading end thereof to engage said selected one of said contacts.

3. The electrical connector as set forth in claim 1 wherein said contact-engaging section is arcuate to define a convex bearing surface engageable with a surface of said selected contact.

4. The electrical connector as set forth in claim 1 wherein said selected contact includes a relatively steep transition section engageable by said contact-engaging section of said switch contact.

5. The electrical connector as set forth in claim 1 wherein said body section of said switch contact includes a slot thereinto for receipt thereinto in an interference fit, of a rib of said housing during insertion of said switch contact into said housing.

6. The electrical connector as set forth in claim 1 wherein said housing includes a relief area for receipt thereinto of said switch contact spring arm upon being deflected rearwardly by a said mating connector.

7. The electrical connector as set forth in claim 1 wherein said housing includes a clearance area adjacent a forward end of said switch contact body section for receipt into said clearance area of portions of said spring arm and contact-loading tooling therealong during switch contact insertion, with said spring arm being held in a partially deflected position during insertion.

* * * * *